US006752119B2

(12) United States Patent
Coleman

(10) Patent No.: US 6,752,119 B2
(45) Date of Patent: Jun. 22, 2004

(54) REMOVABLE TIMING CHAIN COVER

(76) Inventor: Milford Coleman, P.O. Box 36, Red Feather, CO (US) 80545

( * ) Notice: Subject to any disclaimer, the term of this patent is extended or adjusted under 35 U.S.C. 154(b) by 90 days.

(21) Appl. No.: 10/243,573

(22) Filed: Sep. 13, 2002

(65) Prior Publication Data

US 2003/0051695 A1 Mar. 20, 2003

Related U.S. Application Data

(60) Provisional application No. 60/322,353, filed on Sep. 14, 2001.

(51) Int. Cl.[7] ..... F02F 7/00
(52) U.S. Cl. ..... 123/195 C; 123/198 E
(58) Field of Search ..... 123/195 C, 198 E

(56) References Cited

U.S. PATENT DOCUMENTS 4,261,310 A * 4/1981 Laws, Jr. ..... 123/198 E
5,645,024 A * 7/1997 Allen et al. ..... 123/198 E

* cited by examiner

*Primary Examiner*—Noah P. Kamen
(74) *Attorney, Agent, or Firm*—Cochran Freund & Young LLC

(57) ABSTRACT

A removable timing chain cover is mounted to a fixed frame. The removable cover may contain a harmonic balancer seal retainer for quickly replacing the harmonic balancer seal and a removable cam timing cover for adjusting the cam timing. A timing marker may be positioned for different harmonic balancer sizes as well as being circumferentially adjustable for precise positioning. Further, a timing chain tensioner may be mounted to the frame.

14 Claims, 5 Drawing Sheets

REMOVABLE TIMING CHAIN COVER

CROSS REFERENCE TO RELATED APPLICATION

This application claims benefit of U.S. Provisional Application No. 60/322,353 filed Sep. 14, 2001 entitled "Timing Chain Cover" and is hereby specifically incorporated herein by reference.

BACKGROUND OF THE INVENTION a. Field of the Invention

The present invention pertains to timing chain covers for V-8 engines and specifically to timing chain covers for high performance applications.

b. Description of the Background

The conventional timing chain cover Chevrolet small block and big block engines is a stamped sheet metal cover. In high performance applications, such as various forms of racing, there is a need to remove the timing chain cover to perform periodic maintenance or to adjust timing components, such as the cam timing.

In some racing applications such as drag racing, the harmonic balancer seal must be replaced after each race. In order to perform this service procedure, the entire conventional timing chain cover must be removed.

Racers may wish to adjust the various timing characteristics of the engine. For example, the timing marker is typically fixedly mounted to the timing chain cover. The sheet metal timing cover may not have locating features, such as locating pins, to accurately locate the cover to the block. Thus, when the cover is removed and replaced, the timing marker may not be in the exact location. Some racers may wish to more accurately and repeatably position the timing marker.

In another example, the cam timing may be adjusted by adjusting the cam gear at the top of the timing chain. The adjustable cam gear typically requires that the timing chain cover be removed so that the mechanic may have access to the gear. Removal of the timing chain cover, again, typically requires that the harmonic balancer be removed.

Further, the standard timing chain covers may not fit when double roller timing chains are used on the engine. Since the double roller timing chain is wider than the standard timing chain, the factory timing chain cover may need to have a spacer in order to accommodate the wider chain.

Standard timing chains for Chevrolet V-8 engines may not have an adjustment or slack remover that may be typical of other engines.

In some racing applications, an adjustable thrust bearing system may be placed between the timing chain cover and the cam gear to prevent the cam from riding forward during operation.

It would therefore be advantageous to provide a timing chain cover that provides repeatable location for the timing marker and allows for the slight adjustment of the timing marker. It would be further advantageous to provide a cover that allows for quick changeover of the harmonic balancer seal and access to the cam gear for adjusting the cam timing. It would be further advantageous to provide a timing chain cover that allows adjustment of the cam timing without removing the harmonic balancer.

SUMMARY OF THE INVENTION

The present invention overcomes the disadvantages and limitations of the prior art by providing a timing chain cover that comprises a frame that is permanently mounted to the engine block, and a removable cover that is accurately located to the frame. The removable cover may have a harmonic bearing seal retainer that can be accessed without removing the timing chain cover. Further, the timing marker may be precisely adjusted and even relocated for different sized harmonic balancers. The removable cover may contain a second cover that may provide access to the cam gear for adjusting the cam timing. Further, the removable cover may contain provisions for an adjustable thrust bearing to act against the cam gear.

The present invention may therefore comprise a removable timing chain cover for an internal combustion engine comprising: a frame fastened to the block of the engine; a removable cover fastened to the frame, the cover having a locating feature adapted to position the removable cover onto the frame, the cover having an o-ring seal about the periphery of the cover between the cover and the frame; a harmonic balancer seal retainer fastened to the removable cover adapted to retain a seal for the crankshaft of the engine, the harmonic balancer seal having an o-ring seal about the periphery of the seal retainer between the seal retainer and the removable cover; and a timing marker mounted on the removable cover and adapted to be mounted in at least two positions, the timing marker further adapted to be adjusted in position substantially about the axis defined by the crankshaft of the engine.

The present invention may further comprise a removable timing chain cover comprising: a frame fastened to the block of the engine; a oil pan seal holder fastened to the frame and adapted to hold a gasket between the oil pan seal holder and the oil pan of the engine; a removable cover fastened to the frame, the cover having an o-ring seal about the periphery of the cover between the cover and the frame; a harmonic balancer seal retainer fastened to the removable cover adapted to retain a seal for the crankshaft of the engine, the harmonic balancer seal having an o-ring seal about the periphery of the seal retainer between the seal retainer and the removable cover; a timing marker mounted on the removable cover and adapted to be mounted in at least two positions, the timing marker further adapted to be adjusted in position substantially about the axis defined by the crankshaft of the engine; a cam timing cover fastened to the removable cover and adapted to be removed while the harmonic balancer is mounted on the crankshaft of the engine, the cam timing cover having an o-ring seal substantially about the periphery of the cam timing cover between the cam timing cover and the removable cover; and a tensioning system mounted to the frame comprising a spring loaded tensioner and a fixed tensioner.

The advantages of the present invention are that access to various adjustable or replaceable components underneath or attached to a timing chain cover may be serviced or replaced quickly. Further, the o-ring seals between the components that are disassembled can be removed and replaced repeatedly without damage. The harmonic balancer seal may be replaced without having to remove the timing chain cover. In some cases, the cam timing can be adjusted without having to remove the harmonic balancer and complete timing chain cover. The timing marker may be adjusted both for different sized harmonic balancers as well as circumferentially to precisely adjust the timing.

DETAILED DESCRIPTION OF THE INVENTION

Figure 1:
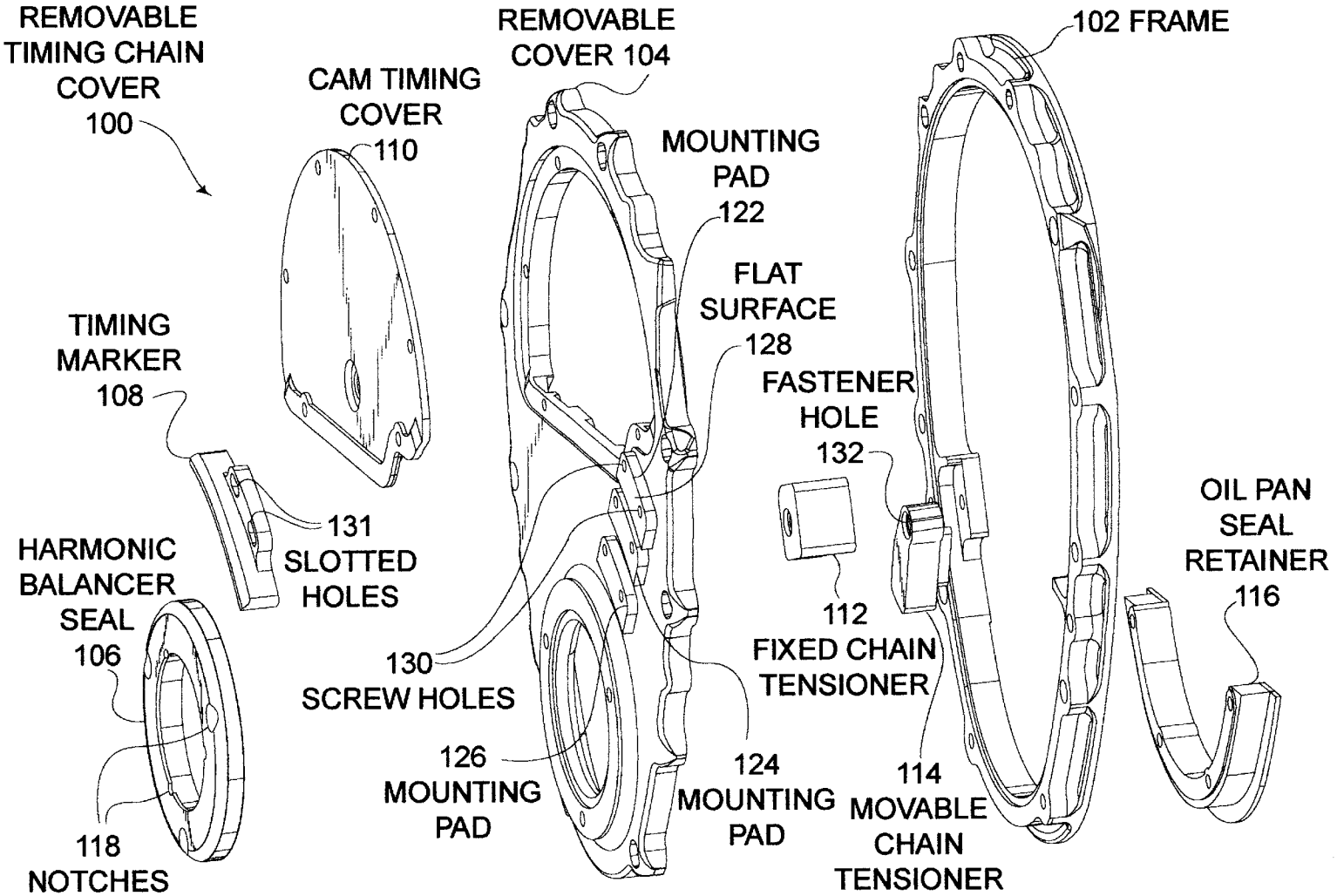
FIG. 1 is an illustration of an exploded view of an embodiment of a removable timing cover system.

FIG. 1 illustrates an embodiment 100 of a removable timing cover system. A frame 102 is mounted to the engine block of an engine. A removable cover 104 mounts to the frame 102 with fasteners and seals to the frame 102 with an o-ring seal. The harmonic balancer seal retainer 106 bolts to the removable cover 104 with an o-ring seal. The timing marker 108 fastens to the removable cover 104. The cam timing cover 110 is fastened to the removable cover 104 and provides access to the cam gear of the engine. An optional fixed timing chain tensioner 112 and movable timing chain tensioner 114 mounts to the frame 102. An oil pan seal retainer 116 holds a gasket to seal to the oil pan of the engine.

The embodiment 100 is designed so that the frame 102 and optional oil pan seal 116 may be mounted to an engine block. The removable cover 104 may be removed without having to remove or loosen the oil pan of the engine, as would have been the case with a stock sheet metal timing chain cover. The removable cover 104 has an o-ring seal between the cover 104 and the frame 102 to prevent any oil leakage. Such a seal is much more maintainable than a conventional paper gasket, as the o-ring seal can be easily disassembled and reassembled many times without any wear or replacement.

The frame 102 and removable cover 104 may engage with interlocking features. Such features may be machined features such as grooves or lips about the periphery or may comprise locating dowel pins or fasteners such as flathead screws or shoulder screws.

The harmonic balancer seal retainer 106 is likewise removably mounted with an o-ring seal between the seal retainer 106 and the removable cover 104. The harmonic balancer seal retainer 106 further has a plurality of notches 118 for quickly removing the seal.

The timing marker 108 may be mounted on mounting pads 122, 124, or 126, depending on the size of the particular harmonic balancer. Each mounting pad contains a flat portion 128 and two screw holes 130 for locating and fastening the timing marker 108. The timing marker is attached with optional slotted holes 131. The holes 131 allow the timing marker to be adjusted when the engine is built, providing a more accurate location for the timing marks than the prior art of a fixed locator.

The cam timing cover 110 is removably mounted to the removable cover 104 and is sealed with an o-ring. The cam timing cover 110 gives access to the cam timing gear of the engine for adjustment purposes without having to remove the harmonic balancer.

The fixed chain tensioner 112 and movable chain tensioner 114 provide a mechanism for keeping the timing chain under constant tension during operation. The fixed timing chain tensioner may be manufactured from a wear resistant material such as ultra high molecular weight polyethylene, acetal, or other plastics. In other embodiments, a roller may be used to ride against the timing chain for both the fixed chain tensioner and the movable chain tensioner.

The movable chain tensioner 114 operates by having a spring mounted to push the movable chain tensioner 114 inward, as it rotates about the axis formed by the fastener hole 132. Embodiments may include a compression spring mounted between the frame 102 and the movable tensioner 114. Other embodiments may use leaf springs, torsion springs, built in springs, or other spring designs. In some cases, the spring may be removable to allow the timing chain to be assembled to the engine prior to applying the spring force to the movable tensioner 114.

The oil pan seal 116 may be used in some applications to effect a seal between the oil pan and the frame 102. This allows the engine oil pan to remain stationary when the removable cover 104 is removed for servicing and adjustment to the various components of the timing chain.

Figure 2:
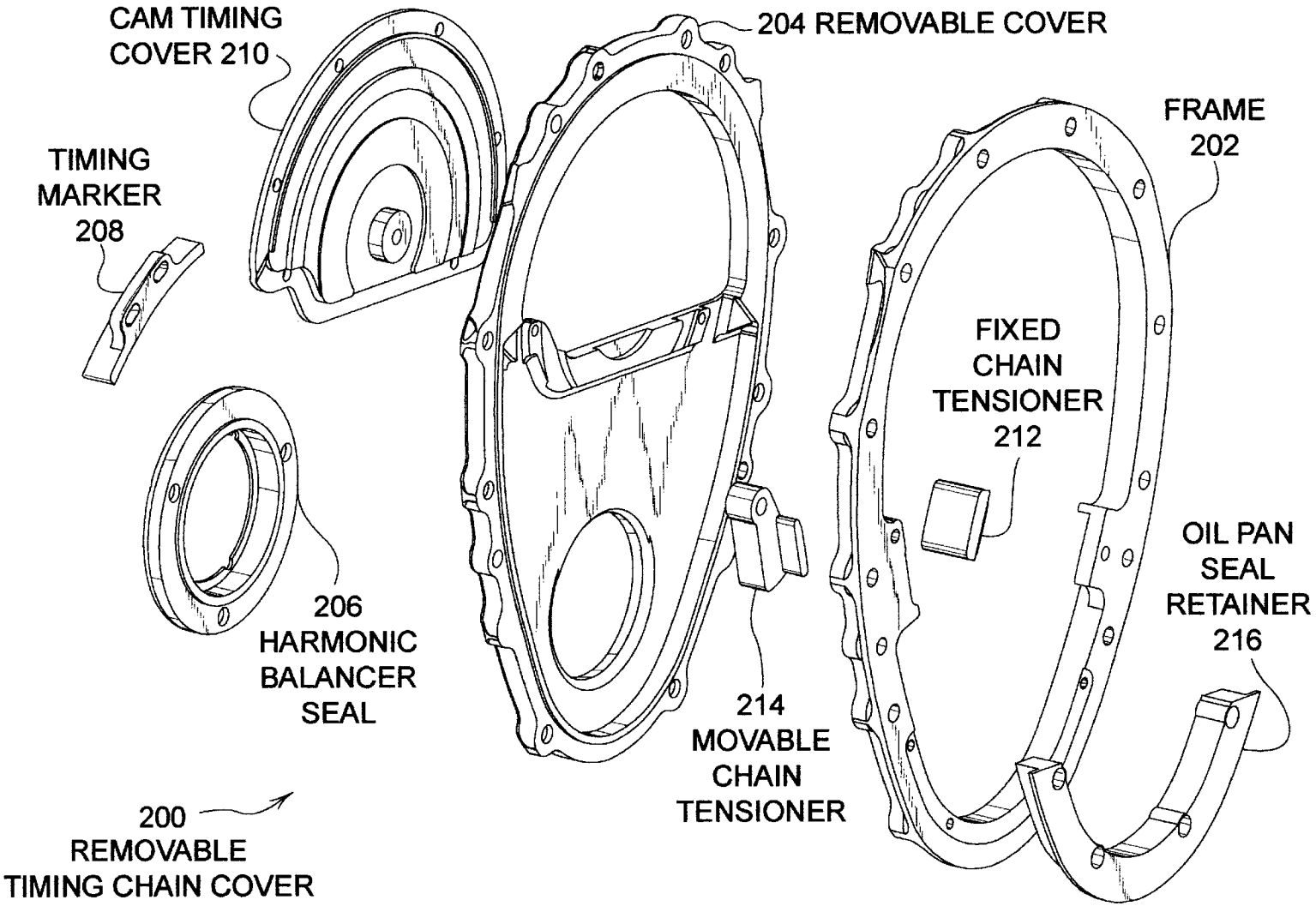
FIG. 2 is an illustration of an exploded view of an embodiment of a removable timing chain cover from the internal perspective.

FIG. 2 illustrates the removable timing chain cover 200 from the internal perspective. The frame 202 mounts to the engine block. The removable cover 204 mounts to the frame 202 with an o-ring seal. The harmonic balancer seal retainer 206 mounts to the removable cover 204 as does the timing marker 208 and cam timing cover 210. The fixed mounted chain tensioner 212 and movable chain tensioner 214 as well as the oil pan seal 216 mount to the frame 202.

The cam timing cover 210 may be optional. In some cases, access to the cam gear is not required to the extent that a removable cover is necessary.

Figure 3:
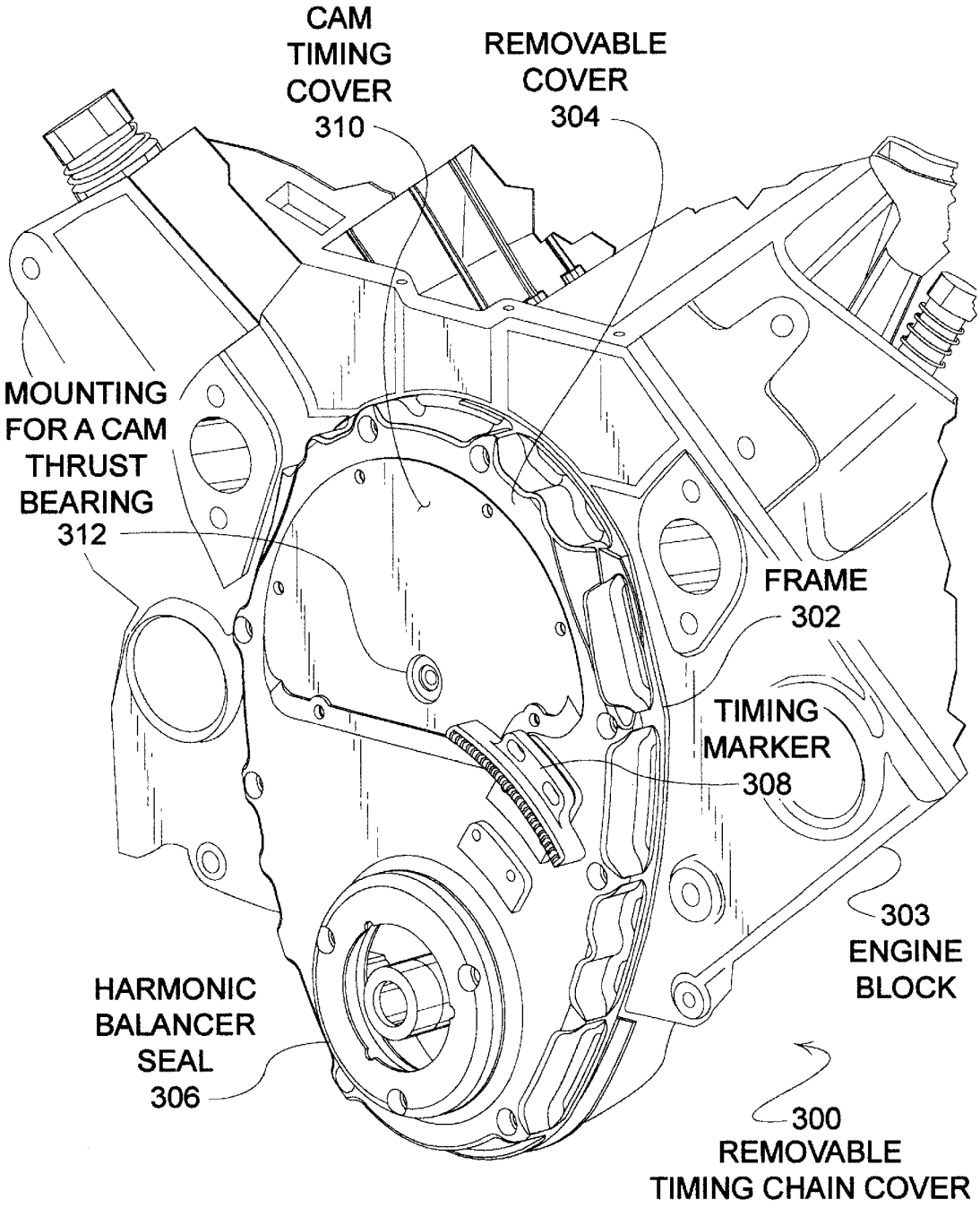
FIG. 3 is an illustration of an embodiment of a removable timing chain cover.

FIG. 3 illustrates a removable timing chain cover 300. The frame 302 is mounted to the engine block 303. The removable cover 304 is mounted to the frame 302. The harmonic balancer seal retainer 306, timing marker 308, and cam timing cover 310 are mounted to the removable cover 304.

The cam timing cover 310 has a hole 312 for mounting a cam thrust bearing (not shown). The cam thrust bearing is used to prevent the cam of the engine from moving toward the front of the engine during high speeds. The cam thrust bearing may be mounted on an adjustable support so that a specific preload may be applied to the camshaft.

Figure 4:
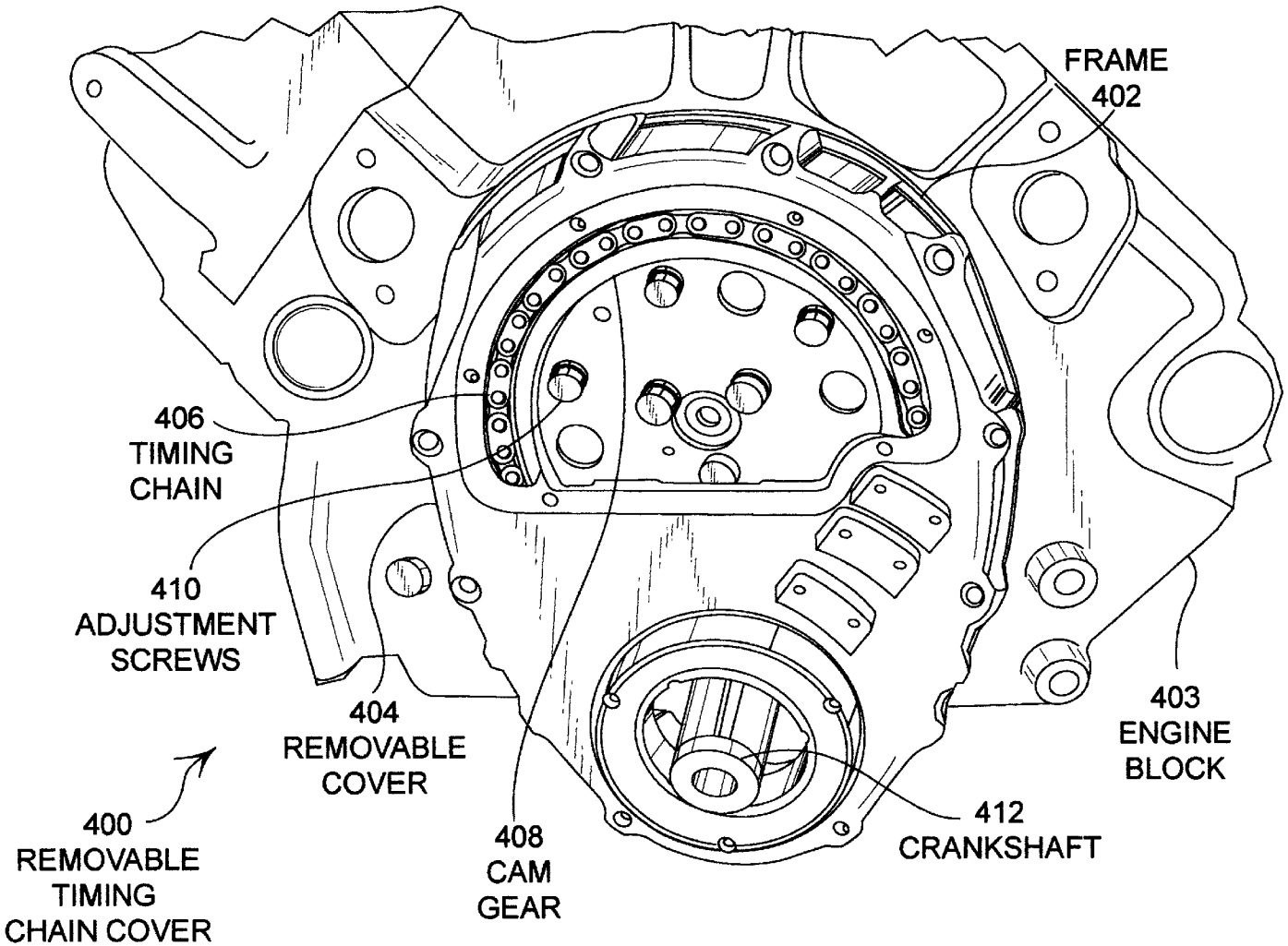
FIG. 4 is an illustration of an embodiment of a removable timing chain cover showing access to the cam gear.

FIG. 4 illustrates an embodiment 400 of the removable timing chain cover. The frame 402 is mounted to the engine block 403. The removable cover 404 is mounted to the frame. The cam timing cover is removed to reveal the timing chain 406 and the cam gear 408. The cam gear 408 is a variety wherein adjustment screws 410 may be loosened and the position of the gear teeth with respect to the cam position may be adjusted with a special cam wrench. The cam gear 408 may be adjusted from the opening provided by removing the cam timing cover and without having to remove the harmonic balancer (not shown) or the removable cover 404.

The crankshaft 412 is shown. The harmonic balancer for the engine mounts on the end of the crankshaft 412 and is not shown for clarity.

Figure 5:
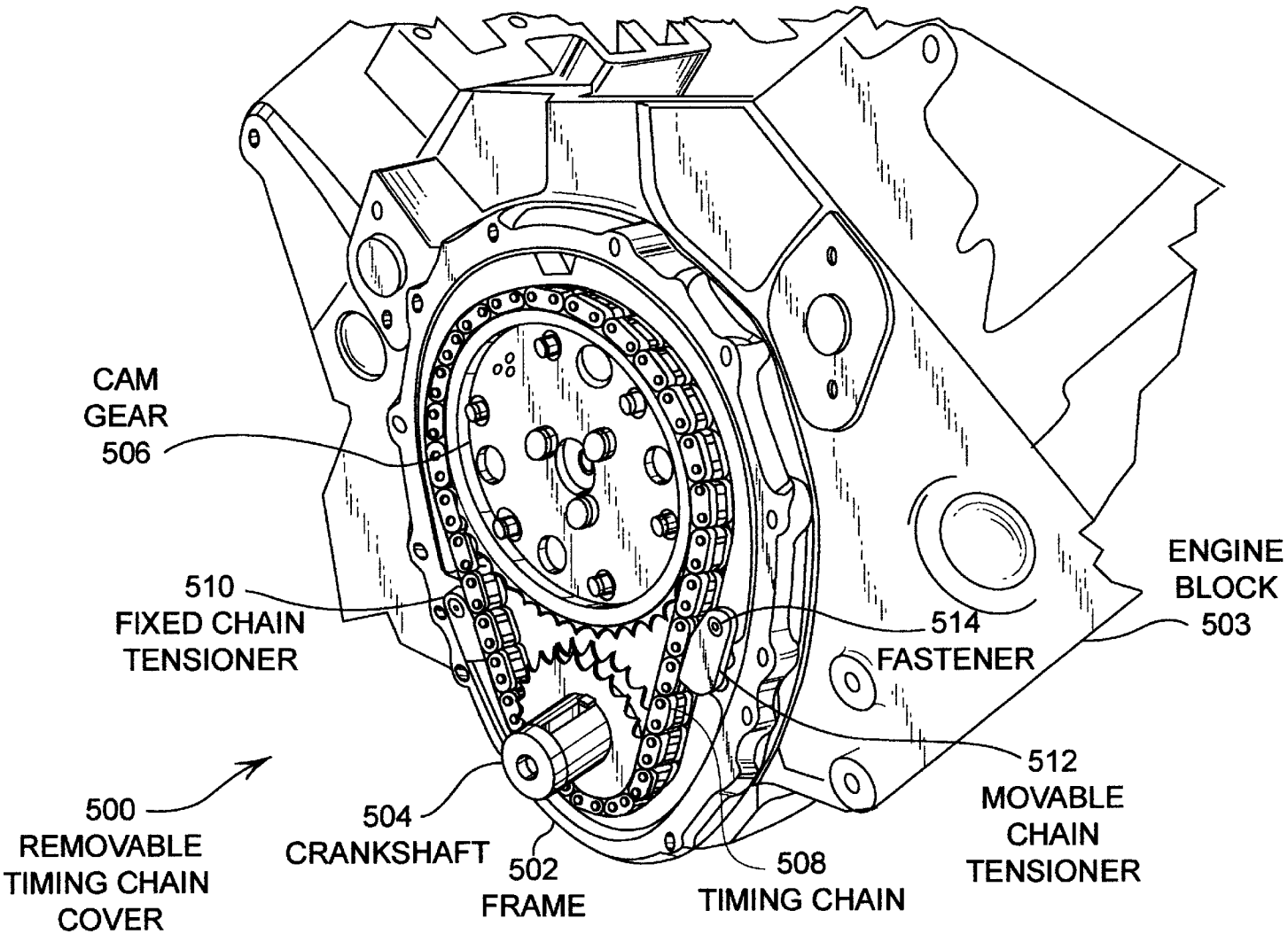
FIG. 5 is an illustration of an embodiment of a removable timing chain cover showing an embodiment of a chain tensioning apparatus.

FIG. 5 illustrates an embodiment 500 of the removable timing chain cover. The frame 502 is mounted on the engine block 503. The crankshaft 504 is connected to the cam gear 506 with the timing chain 508. The fixed chain tensioner 510 and the movable chain tensioner 512 apply force to the timing chain 508 to remove any slack from the chain 508.

The movable timing chain tensioner 512 has a compression spring mounted between the movable timing chain tensioner 512 and the frame 502. The tensioner 512 is permitted to rotate about the fastener 514 to apply tension to the chain 508. Other embodiments of a timing chain tensioner may be envisioned by those skilled in the art while maintaining within the scope and intent of the present invention.

Those skilled in the art will appreciate that the timing chain cover is applicable to any timing mechanism. For example, embodiments may be fabricated for timing drive mechanisms comprising a belt drive, gear drive, or any other timing drive mechanism. For the purposes of the above discussion, the term timing chain was used for convenience. However, the cover system is applicable to all forms of timing drive mechanisms.

The embodiments shown are applicable to Chevrolet V-8 engines, including small block and big block engines. Other applications of the present invention may include other V-8 engines, as well as for any other engine wherein a removable timing chain cover may be used to provide access to the timing chain components in a quick fashion.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A removable timing drive cover for an internal combustion engine comprising:

a frame fastened to the block of said engine;

a removable cover fastened to said frame, said cover having a locating feature adapted to position said removable cover onto said frame, said cover having an o-ring seal about the periphery of said cover between said cover and said frame;

a harmonic balancer seal retainer fastened to said removable cover adapted to retain a seal for the crankshaft of said engine, said harmonic balancer seal having an o-ring seal about the periphery of said seal retainer between said seal retainer and said removable cover; and a timing marker mounted on said removable cover and adapted to be mounted in at least two positions, said timing marker further adapted to be adjusted in position substantially about the axis defined by said crankshaft of said engine.

2. The removable timing drive cover of claim 1 wherein said timing drive comprises a timing chain.

3. The removable timing drive cover of claim 1 wherein said timing drive comprises a timing belt.

4. The removable timing drive cover of claim 1 wherein said timing drive comprises a timing gear.

5. The removable timing drive cover of claim 1 wherein said engine is a V-8 engine.

6. The removable timing drive cover of claim 5 wherein said engine is a Chevrolet small block series engine.

7. The removable timing drive cover of claim 6 further comprising an oil pan seal holder fastened to said frame and adapted to hold a gasket between said oil pan seal holder and the oil pan of said engine.

8. The removable timing drive cover of claim 5 wherein said engine is a Chevrolet big block series engine.

9. The removable timing drive cover of claim 1 further comprising a tensioning system mounted to said frame comprising a spring loaded tensioner and a fixed tensioner.

10. A removable timing drive cover for an engine comprising:

a frame fastened to the block of said engine;

an oil pan seal holder fastened to said frame and adapted to hold a gasket between said oil pan seal holder and the oil pan of said engine;

a removable cover fastened to said frame, said cover having an o-ring seal about the periphery of said cover between said cover and said frame;

a harmonic balancer seal retainer fastened to said removable cover adapted to retain a seal for the crankshaft of said engine, said harmonic balancer seal having an o-ring seal about the periphery of said seal retainer between said seal retainer and said removable cover;

a timing marker mounted on said removable cover and adapted to be mounted in at least two positions, said timing marker further adapted to be adjusted in position substantially about the axis defined by said crankshaft of said engine;

a cam timing cover fastened to said removable cover and adapted to be removed while the harmonic balancer is mounted on said crankshaft of said engine, said cam timing cover having an o-ring seal substantially about the periphery of said cam timing cover between said cam timing cover and said removable cover; and a tensioning system mounted to said frame comprising a spring loaded tensioner and a fixed tensioner.

11. The removable timing chain cover of claim 10 wherein said engine is a V-8 engine.

12. The removable timing chain cover of claim 11 wherein said engine is a Chevrolet small block series engine.

13. The removable timing chain cover of claim 11 wherein said engine is a Chevrolet big block series engine.

14. A removable timing drive cover for an engine comprising:

a frame means fastened to the block of said engine;

a removable cover means removably connected to said frame, said cover means having a sealing means about the periphery of said cover means between said cover means and said frame means;

a harmonic balancer seal retainer means fastened to said removable cover means adapted to retain a seal for the crankshaft of said engine, said harmonic balancer seal means having a sealing means about the periphery of said seal retainer means between said seal retainer means and said removable cover means;

a timing marker means mounted on said removable cover means and adapted to be mounted in at least two positions, said timing marker means further adapted to be adjusted in position substantially about the axis defined by said crankshaft of said engine;

a cam timing cover means fastened to said removable cover means and adapted to be removed while a harmonic balancer is mounted on said crankshaft of said engine, said cam timing cover means having a sealing means substantially about the periphery of said cam timing cover means between said cam timing cover means and said removable cover means; and a tensioning system means mounted to said frame.

* * * * *